United States Patent [19]

Powell et al.

[11] Patent Number: 4,575,883

[45] Date of Patent: Mar. 18, 1986

[54] CONVERTIBLE SOFABED WITH IMPROVED USER COMFORT

[75] Inventors: Larry D. Powell, Mooreville; Charles J. Tidwell, Jr., Tupelo, both of Miss.

[73] Assignee: Mohasco Corporation, Amsterdam, N.Y.

[21] Appl. No.: 623,720

[22] Filed: Jun. 22, 1984

[51] Int. Cl.[4] ..... A47C 17/13; A47C 17/00

[52] U.S. Cl. ..... 5/13; 5/51 E; 5/54

[58] Field of Search ..... 5/13, 29, 51 E, 54, 5/51 D, 28

[56] References Cited

U.S. PATENT DOCUMENTS

| | | | |
|---|---|---|---|
| 2,505,989 | 5/1950 | Pokorny et al. | 5/13 |
| 2,727,250 | 12/1955 | Fox | 5/13 |
| 2,823,389 | 2/1958 | Coopersmith | 5/13 |
| 4,068,328 | 1/1978 | Gerth | 5/13 |

*Primary Examiner*—Alexander Grosz

*Attorney, Agent, or Firm*—Kirschstein, Kirschstein, Ottinger & Israel

[57] ABSTRACT

A convertible sofabed which can be used as a bed in its extended condition and as a sofa in its collapsed condition includes a frame which has a lower frame portion, an upper frame portion, and two upright frame portions as seen in the collapsed condition, the upright frame portions being situated at the front portion of the sofabed and interconnecting the upper and lower frame portions. A raise tube is mounted on the upright frame portions at a considerable distance downwardly from the top regions of the latter as seen in the collapsed condition. A border wire is pivotally mounted on the upper frame portion and supports a front edge portion of a cushion, while the remainder of the cushion rests on a deck resiliently mounted on the frame and serving to support a mattress. The border wire is resiliently supported on the raise tube by a plurality of substantially Z-shaped springs each of which includes one end portion that is introduced into two aligned depressions of the raise tube and passes through the interior of the raise tube between the depressions, and another end portion which is connected to the border wire by a split sleeve which is crimped around the border wire and the other end portion of the spring. A pedestal which receives the frame in its collapsed condition has an elastically yieldable top portion on which the edge portion of the cushion rests as well.

9 Claims, 6 Drawing Figures

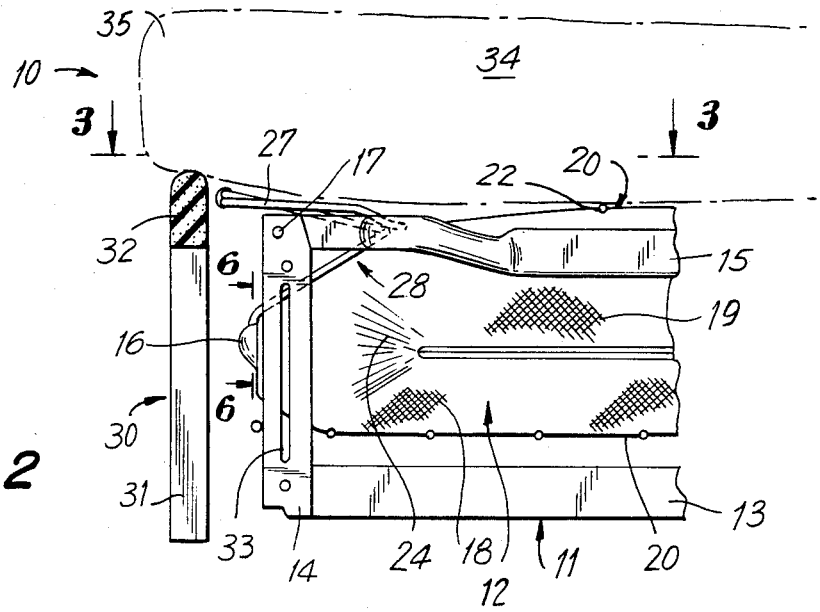
FIG. 2
FIG. 3
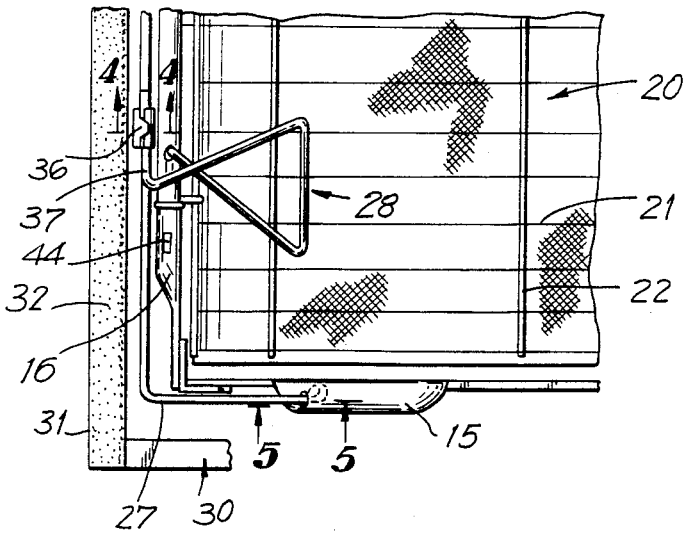
FIG. 4
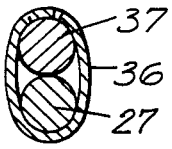
FIG. 5
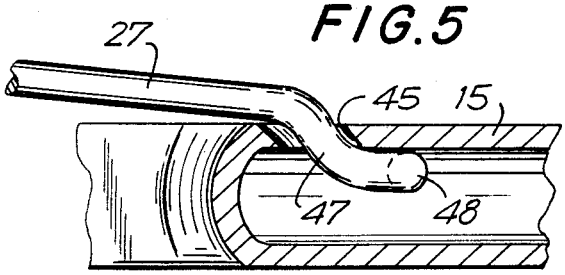
FIG. 6
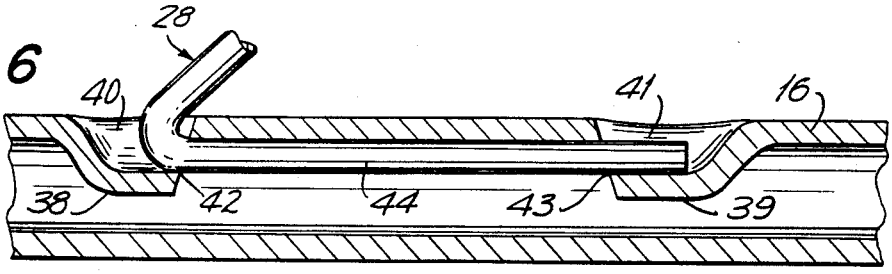

CONVERTIBLE SOFABED WITH IMPROVED USER COMFORT

BACKGROUND OF THE INVENTION

The present invention relates to seat-type furniture in general, and more particularly to sofabeds which can be used as beds in their extended condition, and as sofas in their collapsed condition.

There are already known various constructions of sofabeds of the above type, which can be constructed as armchairs, loveseats or sofas as considered in their collapsed condition, and which are extendable into single or double beds. The present invention is concerned with a particular construction of such a sofabed, but it will be appreciated that the principles disclosed herein can be readily adopted for other sofabed constructions.

A particular problem which is encountered in the conventional convertible sofabed constructions is that, because of the presence of rigid parts of the sofabed frame or support directly below and in contact with the underside of a front edge portion of a seating cushion supported on the sofabed in the collapsed condition of the latter, the presence of such rigid parts will be felt by the user through the front edge portion of the cushion which will be unduly compressed, and will cause the user occupying the sofa pronounced discomfort by pressing against the underside of his or her thighs, interfering with the circulation of blood, and thus causing pain after a prolonged period of sitting on the sofa, if not initially. The unduly compressed cushion is subject to increased wear.

This problem has already been recognized, and it was proposed to support the front edge portion of the cushion on pading and/or springs, especially in conventional, that is, non-convertible sofas. Various examples of such constructions are disclosed, for instance, in the U.S. Pat. Nos. 569,679; 1,326,295; 2,293,964; 2,505,989; 2,624,888; and 2,656,880. However, experience with these known constructions has shown that they still leave much to be desired as far as the user comfort is concerned, so that they did not gain widespread acceptance. A particular problem in convertible sofabeds is the need for a raise tube at the region of the front edge portion of the cushion, the presence of which is felt through the cushion, even if padding and/or springs are being used at this region.

SUMMARY OF THE INVENTION

Accordingly, it is a general object of the present invention to avoid the disadvantages of the prior art.

More particularly, it is an object of the present invention to provide a convertible sofabed which does not possess the disadvantages of the prior art.

It is yet another object of the present invention to provide the sofabed of the type here under consideration with an arrangement for resiliently supporting the front edge portion of the cushion, which arrangement gives the user of the sofabed as a sofa a very comfortable feeling, and prolong the life of the cushion.

Still another object of the present invention is so to construct the arrangement of the above type that the front edge portion of the cushion will rest only on resilently or elastically yieldable parts of the support during the use of the sofabed in its collapsed condition as a sofa.

A concomitant object of the present invention is so to design the arrangement of the above type as to be relatively simple in construction, inexpensive to manufacture, easy to install and use, and reliable in operation nevertheless.

In pursuance of these objects and others which will become apparent hereafter, one feature of the present invention resides in a sofabed convertible between a bed in its extended condition and a sofa in its collapsed condition, this sofabed including a frame having a lower frame portion, an upper frame portion, and two upright frame portions interconnecting the lower and upper frame portions at front corners of the sofabed as considered in the collapsed condition, a deck resilently mounted on the frame portions, a mattress supported on the deck, and a cushion supported on that portion of the deck that is mounted on the upper frame portion in the collapsed condition and having a front edge portion. In this environment, the invention resides in a combination comprising a raise tube rigidly connected to the upright frame portions and situated at a considerable distance downwardly from the upper regions of the upright frame portions as considered in the collapsed condition; and means for resiliently supporting the front edge portion of the cushion in the collapsed condition for improving the comfort of the user of the sofabed as a sofa, such resiliently supporting means including a border wire extending along a substantially U-shaped course and having a main portion extending along the front of the sofabed, and two end portions substantially normal to the main portion and connected to the upper frame portion, and a plurality of substantially Z-shaped springs each having a first portion connected to the raise tube and a second portion connected to the border wire and operative for resiliently urging the border wire away from the raise tube and for yielding under the forces acting on the front edge portion of the cushion resting on the border wire to keep compression of the material of the cushion at the front edge portion of the latter within acceptable limits not causing any discomfort to the user sitting on the cushion. A particular advantage of these expedients is that the raise tube is spaced such a distance downwardly from the cushion that the front end portion of the latter does not come into contact with the raise tube even under the most severe loading conditions, so that the presence of the raise tube is not felt through the cushion in the collapsed condition of the sofabed, and that the front edge portion of the cushion is supported only on the border wire and on the Z-shaped springs which are resiliently yieldable, so that they will yield downwardly under the forces acting in the downward direction on the front edge portion of the cushion due to the weight of the person sitting on the cushion resting on the collapsed sofabed, so that the material of the cushion is not excessively compressed at the front edge portion of the cushion and, consequently, the sofabed occupant does not feel any discomfort, and cushion life is prolonged.

Advantageously, the first portion of the spring is a first end portion, and the raise tube includes a pair of depressions for each of the springs, the depressions having aligned and mutually facing openings through which the first end portion of the spring passes into and out of the interior of the raise tube to be held on the latter for limited pivoting relative thereto but against accidental displacement in the axial direction of the first end portion. It is further advantageous when the second portion of the spring is constituted by a second end portion of the spring, and when the resiliently supporting means further includes a connecting sleeve for each of the springs, the connecting sleeve being circumferentially incomplete and crimped around the border wire and the seceond end portion of the respective spring to connect the latter to the former with limited freedom of movement therebetween in the circumferential directions but against movement in the axial direction of the second end portion. This construction is relatively simple, and yet achieves excellent results as far as the mounting of the spring both on the raise tube and on the border wire is concerned, but also with respect to the utilization of the resiliency of the Z-shaped spring both for supporting the border wire and keeping the spring from dissociating itself from the raise tube and from the border wire.

According to a further advantageous aspect of the present invention which is used when the sofabed includes a pedestal having a front portion that extends along the raise tube frontwardly of the latter in the collapsed condition of the sofabed, the raise tube is situated at a lower elevation than the top of the pedestal in the collapsed condition. This expedient assures that the presence of the raise tube indeed will not be felt through the cushion, since the pedestal itself will prevent the front edge portion of the cushion from being depressed to the level of the raise tube, especially when, in accordance with the present invention, the front edge portion of the cushion is situated above the front portion of the pedestal. In this respect, it is particularly advantageous when the front portion of the pedestal has a rigid lower region and a resiliently yieldable upper region supported on the rigid lower region and yieldably supporting the front edge portion of the cushion. It is especially advantageous when the resiliently yieldable upper region is padding, rubber, or closed cell foam.

A particularly advantageous construction according to the present invention is obtained when there is provided means for connecting the deck to the raise tube for pivoting around the same during the movement of the frame between its extended and collapsed conditions. It is further advantageous when the end portions of the border wire are mounted on the upper frame portion for limited pivoting relative thereto.

The novel features which are considered as characteristic of the invention are set forth in particular in the appended claims. The improved sofabed itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 2 is a side elevational view of a front portion of the sofabed of FIG. 1;

FIG. 3 is a fragmentary top plan view taken on line 3—3 of FIG. 2;

FIG. 4 is an enlarged cross-sectional view of a detail, taken on line 4—4 of FIG. 3;

FIG. 5 is an enlarged sectional view taken on line 5—5 of FIG. 3, and showing another detail; and FIG. 6 is an additional enlarged sectional view, taken on line 6—6 of FIG. 2, and showing an additional detail.

DETAILED DESCRIPTION OF THE PREFERRED EMBODIMENT

Figure 1:
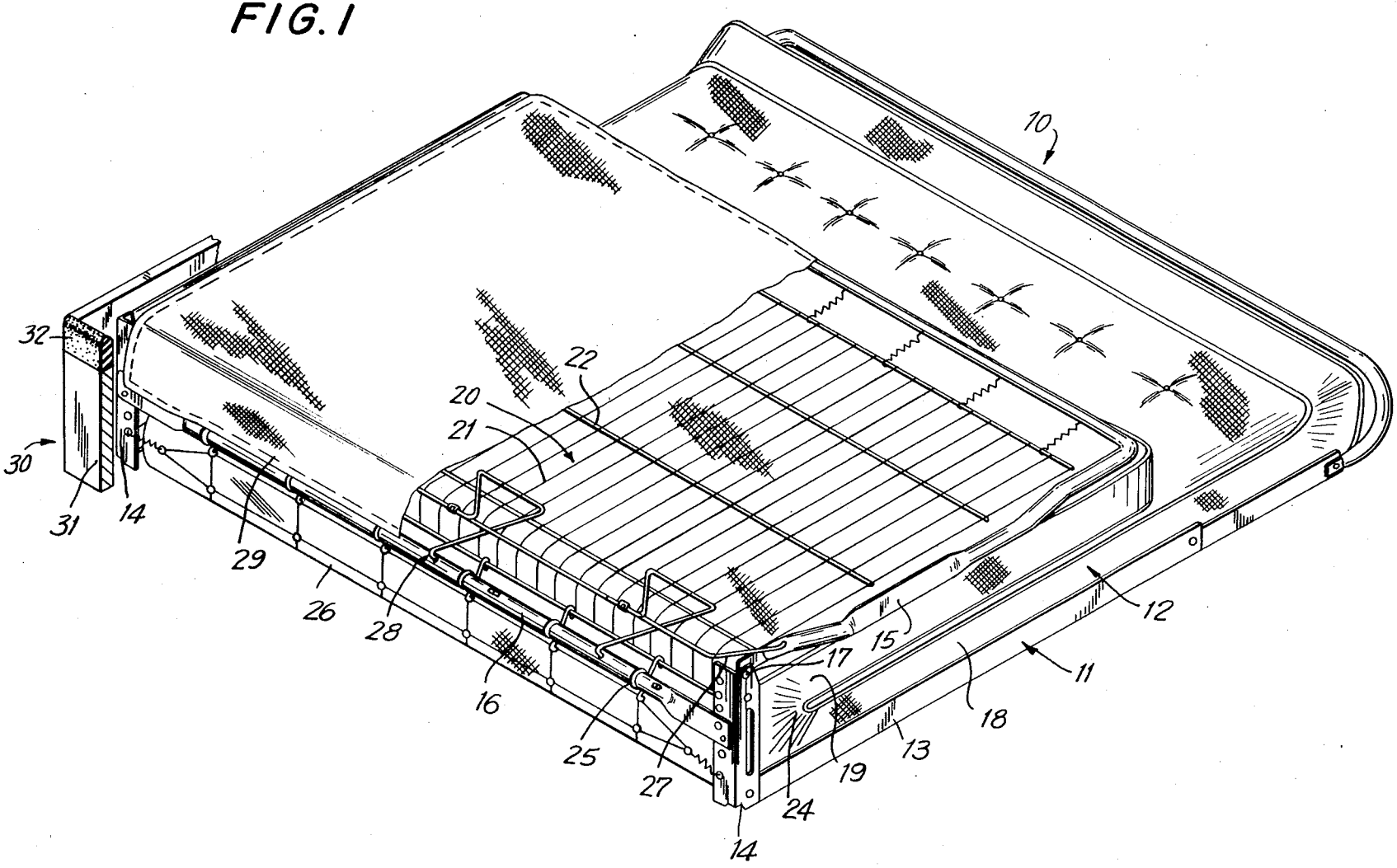
FIG. 1 is a perspective view of a sofabed embodying the present invention in its collapsed condition.

Referring now to the drawing in detail, and first to FIG. 1 thereof, it may be seen that the reference numeral 10 has been used therein to identify a sofabed according to the present invention, in its entirety. The sofabed 10 is shown in the drawing in its collapsed or folded condition, that is, in its condition which it assumes when being used as a sofa. The sofabed includes, as its main components, a frame 11 and a mattress 12. The frame 11 includes a base frame portion 13 to which there are connected two upright frame portions 14 situated at the front corners of the sofabed 10, and an auxiliary frame portion 15. The uprights 14 are rigidly connected to one another by a raise tube 16.

The mattress 12 includes two mattress portions 18 and 19 which are folded on top of one another in the collapsed condition of the sofabed 10 and which, in the extended position of the sofabed 10 in which the mattress portion 19 forms a continuation of the mattress portion 18 along a common plane, are supported on a deck 20 of any conventional foldable construction which is mounted on the frame 11. As shown, the deck 20 may include a plurality of parallel wires or similar elongated members 21 which are connected to and held apart by spaced transverse rods or similar elongated elements 22. The deck is preferably resiliently mounted on the frame 11, by springs.

The components described so far can be found in many known constructions of sofabeds, so that they need not be discussed in too much detail here. However, it has to be mentioned that, for reasons which will be discussed below, the raise tube 16 is situated at a considerably lesser elevation from the ground than in the conventional sofabed constructions. The central or fold portion of the mattress 12, which is denoted by the reference numeral 24, is supported on the raise tube 16 by means of mounting hooks 25 that are capable of turning about the longitudinal axis of the raise tube 16 and which engage one of the elongated elements 22 of the deck 20. A resiliently mounted biasing arrangement 26, which is of a conventional construction as well and hence need not be explained here in any detail, urges the mounting hooks 25 toward their illustrated positions, but permits them to conduct the above-mentioned pivoting movement about the raise tube 16. Suffice it to say that, because of this construction, the raise tube 16 serves as an axle for folding and unfolding of the sofabed 10, and as a support for the fold portion 24 of the mattress 12 both in its collapsed and in its extended or unfolded condition.

FIG. 1 also shows that a border wire 27 is pivotally mounted on the auxiliary frame portion 15, and that a plurality of substantially Z-shaped springs 28 is used to support the border wire 27 on the raise tube 16. These springs 28 will be discussed in detail later. It may also be seen in FIG. 1 that a liner 29 can be provided, which covers the deck 20 to protect the same and/or other components of the sofabed 10 from damage, as well as that an outer frame or pedestal 30 may be provided, especially to give the sofabed 10 in its collapsed condition the appearance of a regular sofa. The pedestal 30 is shown to include a rigid portion 31, usually made of wood, plywood or particleboard, and a resilient top portion 32 which is rigidly connected to the rigid portion 31 by any conventional connecting means, such as by an adhesive, a plurality of fasteners, such as nails or the like, or by being encased in a common upholstery envelope.

Turning now to FIG. 2, it may be seen that the auxiliary frame portion 15 is mounted on the respective upright frame portion 14 for pivoting relative thereto about a pivot 17. The frame 11 is mounted on the pedestal or outer frame 30 for movement up and down during the unfolding and folding thereof. Such mounting may be accomplished in a conventional manner, for instance, by means of an elongated slot 33 provided in each of the upright frame portions 14 and receiving a guiding pin secured to the outer frame 30. In this manner, the lower frame portion 11 can rise during the unfolding, until it reaches the elevation of the top of the outer frame or pedestal 30. On the other hand, in the illustrated collapsed condition, the frame 11 is located in its entirety below the level of the top of the pedestal 30, and so is the mattress 12. In the collapsed condition, a cushion 34 is supported on the collapsed combination of the frame 11 with the mattress 12. It may be seen that the cushion 34 has a front edge portion 35 which extends frontwardly beyond the frame 11 and above the outer frame 30.

FIG. 3 illustrates, in top plan view, how the substantially Z-shaped spring 28 is configurated, and how it is connected to the raise tube 16, on the one hand, and to the border wire 27, on the other hand. A split sleeve 36, which is crimped around a portion 37 of the spring 28 and around the border wire 27, is used for connecting the spring 28 to the border wire 27, as best seen in FIG. 4. It will be appreciated that the crimped sleeve 36 will permit the spring 28 to conduct pivotal movement about the axis of the portion 37, as well as, to a limited extent, about the axis of the border wire 27, to the extent warranted by the relative movement between the spring 28 and the border wire 27 and the resiliency of the spring 28. On the other hand, substantially no axial movement will take place between the sleeve 36, on the one hand, and the spring 28, so that the spring portion 37 will be securely connected by the sleeve 36 to the border wire 27.

FIG. 6 shows in detail how the spring 28 is mounted on and in the raise tube 16. For this purpose, the raise tube 16 is provided with two deflected or punched-out portions 38 and 39 which bound respective depressions or recesses 40 and 41, respectively. The recesses 40 and 41 respectively communicate with the interior of the raise tube 16 through openings 42 and 43. An end portion 44 of the spring 28 is introduced into the recess 40, then through the opening 42 into the interior of the raise tube 16, and then through the opening 43 into the recess 41. Once so introduced, the spring end portion 44 cannot dissociate itself from the raise tube 16 on its own accord, since intricate maneuvering would be needed for this purpose, and this does not result from mere use of the sofabed 10. Moreover, the resiliency of the spring 28 will hold the spring end portion 44 in its illustrated position, in which it is securely connected to the raise tube 16. Here again, however, limited pivoting of the spring 28 about the axis of the spring end portion 44 can occur, as warranted or required by the relative movement between the border wire 27 and the raise tube 16, especially during the folding and unfolding of the sofabed 10.

Each Z-shaped spring 28 is also connected to the deck. Between its spring end portions, each spring 28 has a Z-shaped central portion which is intertwined and intermeshed, both over and under the elongated deck elements 22.

Finally, FIG. 5 illustrates the manner in which the border wire 27 is mounted on each of the lateral regions of the auxiliary frame portion 15. To this end, the respective lateral region of the auxiliary frame portion 15 is provided with an aperture 45 into which a bent end portion 47 of the border wire 27 is inserted and through which it passes into the interior of the lateral region of the frame portion 15. The end portion 47 is shown to have an end zone 48 which extends at a right angle to the plane of the remainder of the end portion 47, so that extensive manipulation is needed for disconnecting the border wire 27 from the auxiliary frame portion 15. This, again, is advantageous in order to prevent unintended dissociation of the border wire 27 from the auxiliary frame portion 15.

Having so described the construction of the arrangement of the present invention, its operation will now be briefly discussed to the extent necessary for understanding the contribution to the art as presented by the invention.

During the unfolding of the sofabed from the condition shown in FIG. 2, the auxiliary frame portion 15 will pivot about the pivot 17, and the upright portions 14 as well as the lower portion 13 of the frame 11 will rise, until they clear the top of the pedestal 30. This occurs in a manner which is well known to those versed in this art, so that no additional explanation is deemed to be necessary. In this respect, there is no substantive difference between the prior-art constructions and that of the instant invention.

However, the reason for utilizing the above-discussed expedients will become apparent when FIG. 2 is considered, with the sofabed 10 in its collapsed condition. It may be seen that the springs 28, together with the border wire 27, support the front edge portion 35 of the cushion 34. This support takes place in a resilient manner, that is, both the sprins 28 and the border wire 27 are deflected downwardly when the weight of the thigh of the person sitting on the sofabed 10 rests on the cushion edge portion 35. Thus, the material of the cushion edge portion 35 will be compressed to a much lesser extent than in conventional sofabed constructions, and the user of the sofabed in its collapsed condition will feel much more comfortable than on previously known sofabeds. This comfort is further enhanced by the provision of the resilient top portion or padding 32 on the pedestal 30, since the padding 32 will be compressed as well, thus once more reducing the degree of compression of the cushion front edge 35. Moreover, since the raise tube 16 is situated much lower than in conventional sofabed constructions and below the top of the rigid portion 31 of the pedestal 30, the cushion 34 will not contact the same and hence the presence of the raise tube 16 cannot be felt through the cushion front edge portion 35. This means that the portion 35 will be supported in such a manner that the presence of rigid elements below the same will not cause any discomfort to the user of the sofabed 10 as a sofa.

It will be understood that each of the elements described above, or two or more together, may also find a useful application in other types of arrangements differing from the type described above.

While the invention has been illustrated and described as embodied in a sofabed, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the claims.

What is claimed as new and desired to be protected by Letters Patent is set forth in the appended claims:

1. In a sofabed convertible between a bed in its extended condition and a sofa in its collapsed condition and including a frame having a lower frame portion, an upper frame portion, and two upright frame portions interconnecting said lower and upper frame portions at front corners of the sofabed as considered in its collapsed condition, a deck resiliently mounted on the frame portions, a mattress supported on the deck, anda cushion supported on that portion of the deck which is mounted on the upper frame portion in the collapsed condition and having a front edge portion, a combination comprising a raise tube rigidly connected to the upright frame portions and situated at a considerable distance from the upper regions of the latter as considered in the collapsed condition; and means for resiliently supporting the front edge portion of the cushion in the collapsed condition ror improving the comfort of the user of the sofabed as a sofa, including a border wire extending along a substantially U-shaped course and having a main portion extending along the front of the sofabed, and two end portions substantially normal to said main portion and connected to said upper frame portion; and a plurality of substantially Z-shaped springs each having a first portion connected to said raise tube and a second portion connected to said border wire and operative for resiliently urging said border wire away from said raise tube and for yielding under the forces acting on the front edge portion of the cushion resting on said border wire to keep compression of the material of the cushion at the front edge portion of the latter within acceptable limits not causing any discomfort to the user sitting on the cushion.

2. In the sofabed as defined in claim 1, wherein said first portion of said spring is a first end portion; and wherein said raise tube includes a pair of depressions for each of said springs, said depressions having aligned and mutually facing openings through which said first end portion of said spring passes into and out of the interior of said raise tube to be held on the latter for limited pivoting relative thereto but against accidental displacement in the axial direction of said first end portion.

3. In the sofabed as defined in claim 1, wherein said second portion of said spring is a second end portion; and wherein said resiliently supporting means further includes a connecting sleeve for each of said springs, said connecting sleeve being circumferentially incomplete and crimped around said border wire and said second end portion of the respective spring to connect the latter to the former with limited freedom of movement therebetween in the circumferential directions but against movement in the axial direction of said second end portion.

4. In the sofabed as defined in claim 1 and further including a pedestal having a front portion that extends along said raise tube frontwardly of the latter in the collapsed condition, and wherein said raise tube is situated at a lower elevation than the top of the pedestal in the collapsed condition.

5. In the sofabed as defined in claim 1, wherein the front edge portion of the cushion is situated above said front portion of said pedestal to be supported thereon.

6. In the sofabed as defined in claim 5, wherein said front portion of said pedestal has a rigid lower region and a resilently yieldable upper region supported on said rigid lower region and yieldably supporting said front edge portion of said cushion.

7. In the sofabed as defined in claim 6, wherein said resilently yieldable upper region of said pedestal is of a padding material.

8. In the sofabed as defined in claim 1, wherein said combination further includes means for connecting said deck to said raise tube for pivoting around the same during the movement of the frame between its extended and collapsed conditions.

9. In the sofabed as defined in claim 1, wherein said end portions of said border wire are mounted on said upper frame portion for limited pivoting relative thereto.

* * * * *